US006863037B2

(12) United States Patent
Iizuka et al.

(10) Patent No.: US 6,863,037 B2
(45) Date of Patent: Mar. 8, 2005

(54) CONTROL UNIT FOR VARIABLE VALVE TIMING MECHANISM

(75) Inventors: Isamu Iizuka, Atsugi (JP); Hirokazu Shimizu, Atsugi (JP)

(73) Assignee: Unisia Jecs Corporation, Atsugi (JP)

( * ) Notice: Subject to any disclaimer, the term of this patent is extended or adjusted under 35 U.S.C. 154(b) by 0 days.

(21) Appl. No.: 10/166,170

(22) Filed: Jun. 11, 2002

(65) Prior Publication Data

US 2002/0189562 A1 Dec. 19, 2002

(30) Foreign Application Priority Data

Jun. 19, 2001 (JP) ..... 2001-184875

(51) Int. Cl.[7] ..... F01L 1/34

(52) U.S. Cl. ..... 123/90.17; 123/90.15; 74/568 R; 92/121

(58) Field of Search ..... 123/90.12, 90.15–90.18, 123/320–322, 90.27, 90.31; 74/568 R; 464/1, 2, 160; 92/121, 122

(56) References Cited

U.S. PATENT DOCUMENTS 5,417,187 A * 5/1995 Meyer et al. ..... 123/90.17
5,765,514 A * 6/1998 Sono et al. ..... 123/90.11
5,979,413 A * 11/1999 Ohnuma et al. ..... 123/491
6,058,766 A * 5/2000 Onuma et al. ..... 73/117.3
6,199,523 B1 * 3/2001 Neubauer et al. ..... 123/90.15
6,276,316 B1 * 8/2001 Arai et al. ..... 123/90.11
6,357,403 B1 * 3/2002 Yano ..... 123/90.11

FOREIGN PATENT DOCUMENTS

JP 7-332118 12/1995

* cited by examiner

*Primary Examiner*—Thomas Denion
*Assistant Examiner*—Jaime Corrigan
(74) *Attorney, Agent, or Firm*—Foley & Lardner LLP

(57) ABSTRACT

A controller that outputs control signals to an actuator of a variable valve timing mechanism is integrally equipped with a cam sensor that takes out from a camshaft signals for discriminating a cylinder corresponding to a reference piston position. The controller discriminates the cylinder corresponding to the reference piston position, computes a rotation phase of the camshaft relative to a crankshaft, and transmits the result of the cylinder discrimination process to an engine controller.

7 Claims, 8 Drawing Sheets

CONTROL UNIT FOR VARIABLE VALVE TIMING MECHANISM

FIELD OF THE INVENTION

The present invention relates to a control unit for a variable valve timing mechanism that changes a rotation phase of a camshaft relative to a crankshaft.

RELATED ART OF THE INVENTION

A typical conventional control unit for a variable valve timing mechanism is disclosed in Japanese Unexamined Patent Publication No. 7-332118.

The above-mentioned conventional control unit comprises an engine control apparatus that receives detection signals from a cam sensor and detection signals from a crank sensor through a harness.

The engine control apparatus computes a rotation phase of a camshaft relative to a crankshaft, and outputs an actual rotation phase and a target rotation phase to a control circuit that controls an actuator of the variable valve timing mechanism.

Upon receiving input of the actual rotation phase and the target rotation phase, the control circuit feedback controls the actuator so as to bring the actual rotation phase to coincide with the target rotation phase.

The above-mentioned cam sensor is mounted near the camshaft at a cylinder head.

Therefore, when the detection signals from the cam sensor are input through the harness, ignition noise is liable to mix from the harness portion into the detection signals.

This leads to problems in that accuracy of cylinder discrimination process for determining a cylinder corresponding to a reference piston position based on the detection signals from the cam sensor is deteriorated, and detection accuracy of the rotation phase of the camshaft based on the detection signals from the cam sensor is also deteriorated.

SUMMARY OF THE INVENTION

Therefore, the present invention aims at preventing deterioration of the cylinder discrimination process accuracy or the rotation phase detection accuracy due to ignition noise, in a construction where a cylinder corresponding to a reference piston position is discriminated based on detection signals from a cam sensor and at the same time, a rotation phase is detected by a variable valve timing mechanism.

In order to achieve the above objects, the present invention provides a control unit for a variable valve timing mechanism, comprising a cam sensor that takes out from a camshaft signals for discriminating a cylinder corresponding to a reference piston position, and a controller that outputs control signals to an actuator of the variable valve timing mechanism and is equipped with the cam sensor integrally.

The other objects and features of the invention will become understood from the following description with reference to the accompanied drawings.

DETAILED DESCRIPTION OF PREFERRED EMBODIMENTS

Figure 1:
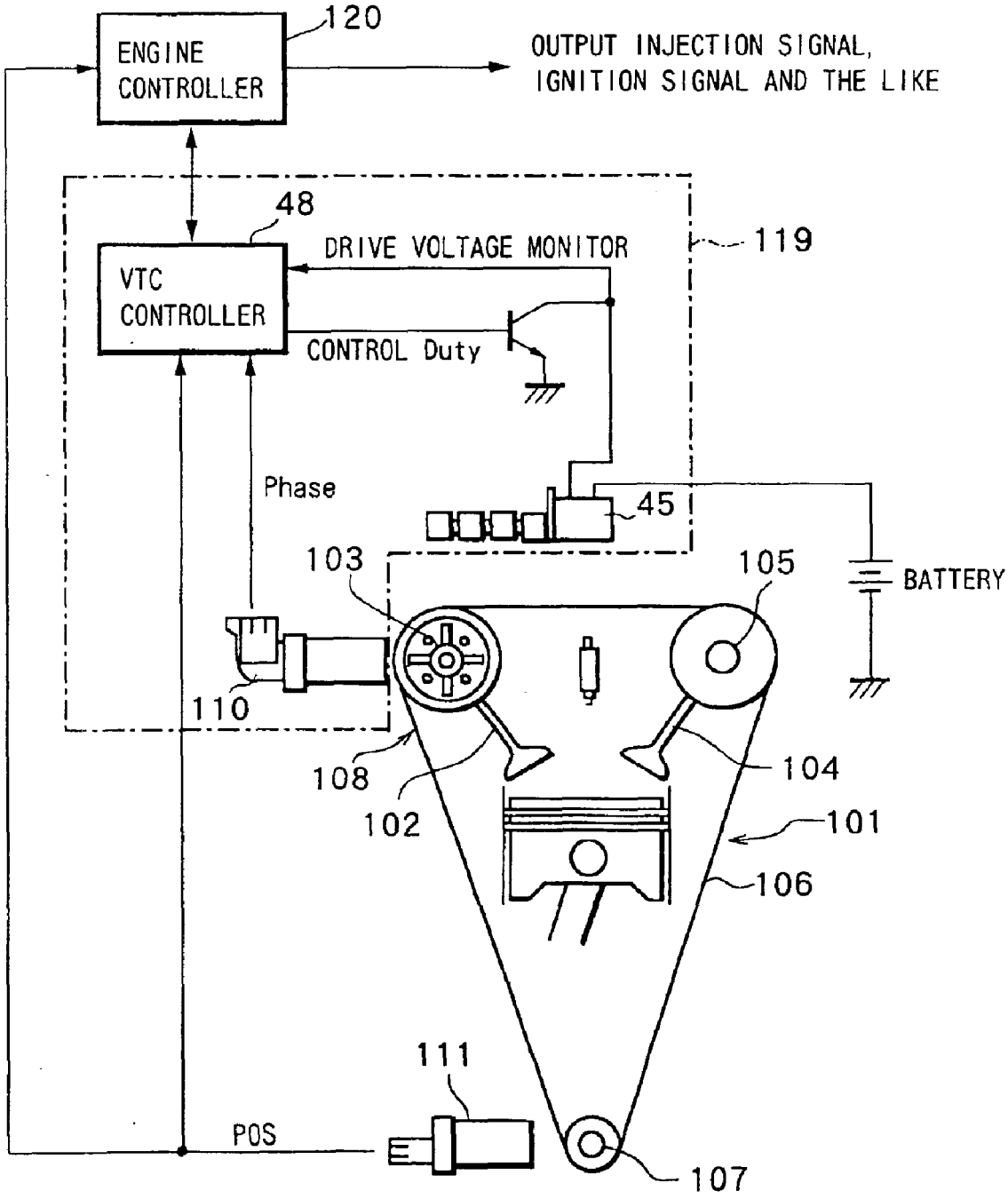
FIG. 1 is a diagram showing a system configuration of an engine.

FIG. 1 shows a system configuration of an engine according to an embodiment of the present invention.

An engine 101 shown in FIG. 1 is an in-line four-cylinder engine equipped with an intake side camshaft 103 that drives an intake valve 102 to open or close, and an exhaust side camshaft 105 that drives an exhaust valve 104 to open or close.

Intake side camshaft 103 and exhaust side camshaft 105 are driven to rotate by a crankshaft 107 via a timing chain 106.

Intake side camshaft 103 is equipped with a variable valve timing mechanism 108 that changes a rotation phase of intake side camshaft 103 relative to crankshaft 107.

Here, a structure of variable valve timing mechanism 108 will be described with reference to FIGS. 2 to 4.

Figure 2:
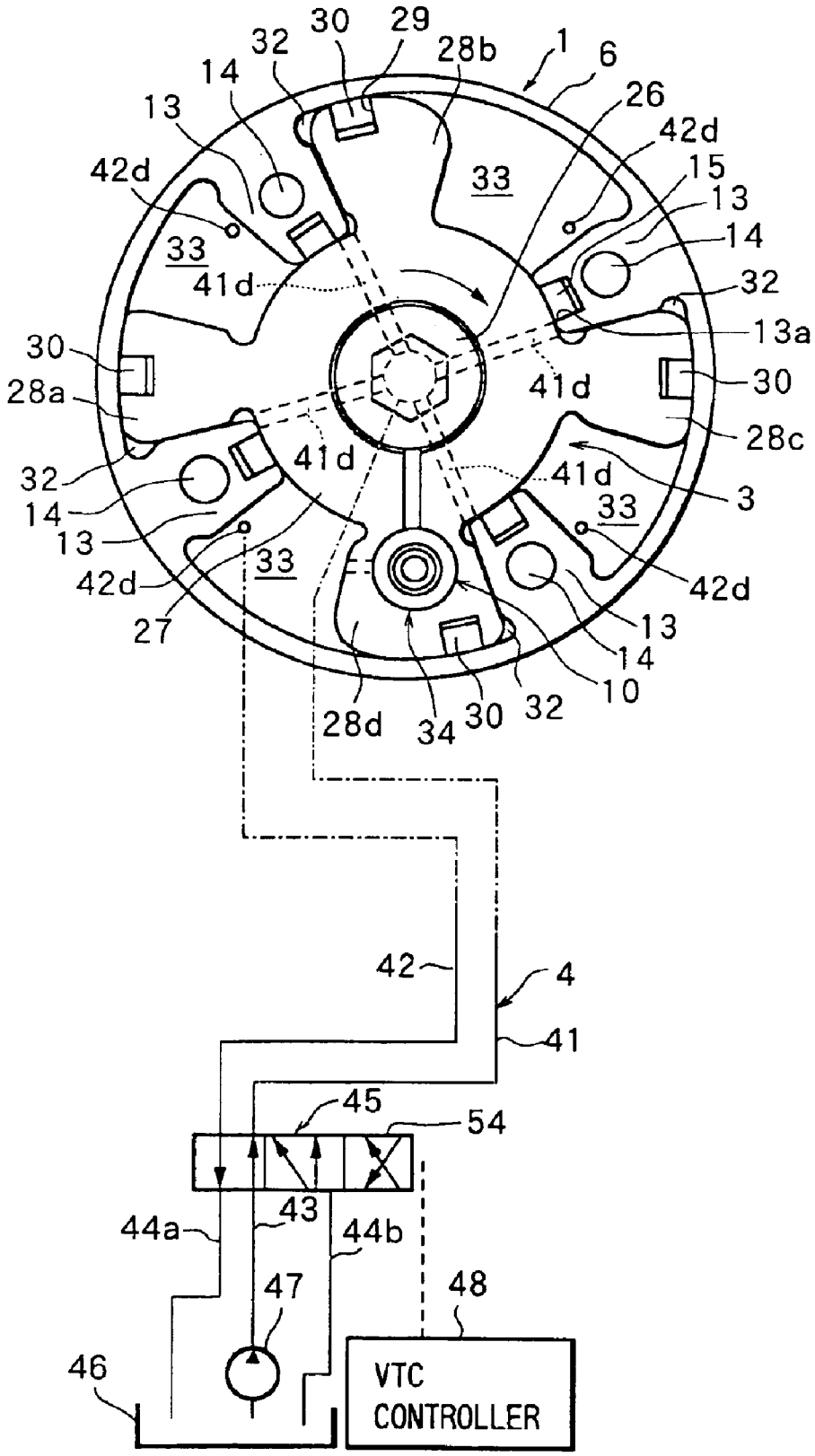
FIG. 2 is a cross-sectional view showing a variable valve timing mechanism.

The vane type variable valve timing mechanism 108 shown in FIG. 2 comprises: a cam sprocket 1 which is rotatably driven by crank shaft 107 via timing 106; a rotation member 3 secured to an end portion of camshaft 103 and roatably housed inside cam sprocket 1; a hydraulic circuit 4 for relatively rotating member 3 with respect to cam sprocket 1; and a lock mechanism 10 for selectively locking a relative rotation position between cam sprocket 1 and rotation member 3 at a predetermined position.

Cam sprocket 1 comprises: a rotation portion having on an outer periphery thereof, teeth for engaging with timing chain 106; a housing 6 located forward of the rotation portion, for rotatably housing rotation member 3; and a front cover and a rear cover for closing the front and rear openings of housing 6.

Furthermore, housing 6 presents a cylindrical shape formed with both front and rear ends open and with four partition portions 13 protrudingly provided at positions on the inner peripheral face at 90° in the circumferential direction.

Partition portions 13 present a trapezoidal shape in transverse section, and are respectively provided along the axial direction of housing 6. Each of the opposite end edges are in the same plane as the opposite end edges of housing 6.

Further, on the base edge side of partition portions 13 are formed four bolt through holes 14 in the axial direction, through which bolts are inserted for axially and integrally coupling the rotation portion, housing 6, the front cover and the rear cover.

Moreover, inside of retention grooves 13*a* formed as cut-outs along the axial direction in central locations on the inner edge faces of each partition 13 are engagingly retained seal members 15.

Rotation member 3 is secured to the front end portion of the camshaft by means of a fixing bolt 26, and comprises an annular base portion 27 having, in a central portion, a bolt hole through which fixing bolt 26 is inserted, and four vanes 28*a*, 28*b*, 28*c*, and 28*d* integrally provided on an outer peripheral face of base portion 27 at 90° locations in the circumferential direction.

First through fourth vanes 28*a* to 28*d* each presents a cross-section of approximate trapezoidal shape. The vanes are disposed in the recess portions between each partition portion 13 so as to form spaces in the recess portions to the front and rear in the rotation direction. Advance angle side hydraulic chambers 32 and delay angle side hydraulic chambers 33 are thus formed between the opposite sides of vanes 28*a* to 28*d* and the opposite side faces of respective partition portions 13.

Inside of respective retention grooves 29 notched axially in the center of the outer peripheral faces of respective vanes 28*a* to 28*d* are engagingly retained seal members 30 for rubbing contact with inner peripheral faces of housing 6.

Lock mechanism 10 has a construction such that a lock pin 34 is inserted into an engagement hole at a rotation position on the maximum delay angle side of rotation member 3.

Figure 3:
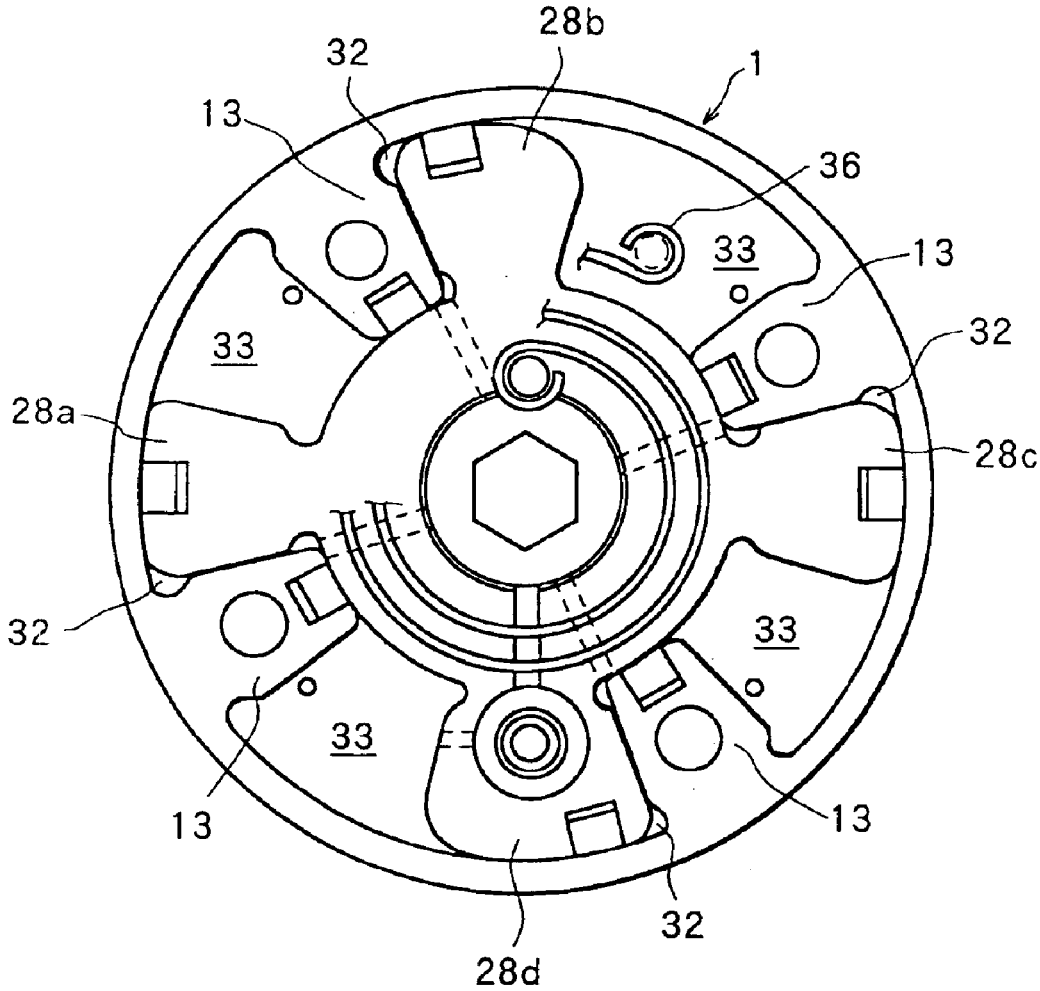
FIG. 3 is a cross-sectional view showing in detail vane portions in the variable valve timing mechanism.

Moreover, as shown in FIG. 3, rotation member 3 (vanes 28*a* to 28*d*) has a construction such that one end thereof is secured to the front cover, and the other end is urged to the delay angle side by a spiral spring 36 serving as a resilient body, secured to base portion 27 by a pin.

As the resilient body for urging rotation member 3 (vanes 28*a* to 28*d*), an extension/compression coil spring, a torsion coil spring, a plate spring or the like may be used instead of spiral spring 36.

Hydraulic circuit 4 has a dual system oil pressure passage, namely a first oil pressure passage 41 for supplying and discharging oil pressure with respect to advance angle side hydraulic chambers 32, and a second oil pressure passage 42 for supplying and discharging oil pressure with respect to delay angle side hydraulic chambers 33.

To these two oil pressure passages 41 and 42 are connected a supply passage 43 and drain passages 44*a* and 44*b*, respectively, via an electromagnetic switching valve 45 for switching the passages.

An engine driven oil pump 47 for pumping oil inside an oil pan 46 is provided in supply passage 43.

And the downstream ends of drain passages 44*a* and 44*b* are communicated with oil pan 46.

First oil pressure passage 41 is formed substantially radially in base portion 27 of rotation member 3, and connected to four branching paths 41*d* communicating with each advance angle side hydraulic chamber 32. Second oil pressure passage 42 is connected to four oil galleries 42*d* opening to each delay angle side hydraulic chamber 33.

With electromagnetic switching valve 45, an internal spool valve is arranged so as to control relative switching between respective oil pressure passages 41 and 42, and supply passage 43 and first and second drain passages 44*a* and 44*b*. The switching operation is effected by a control signal from a controller 48.

Figure 4:
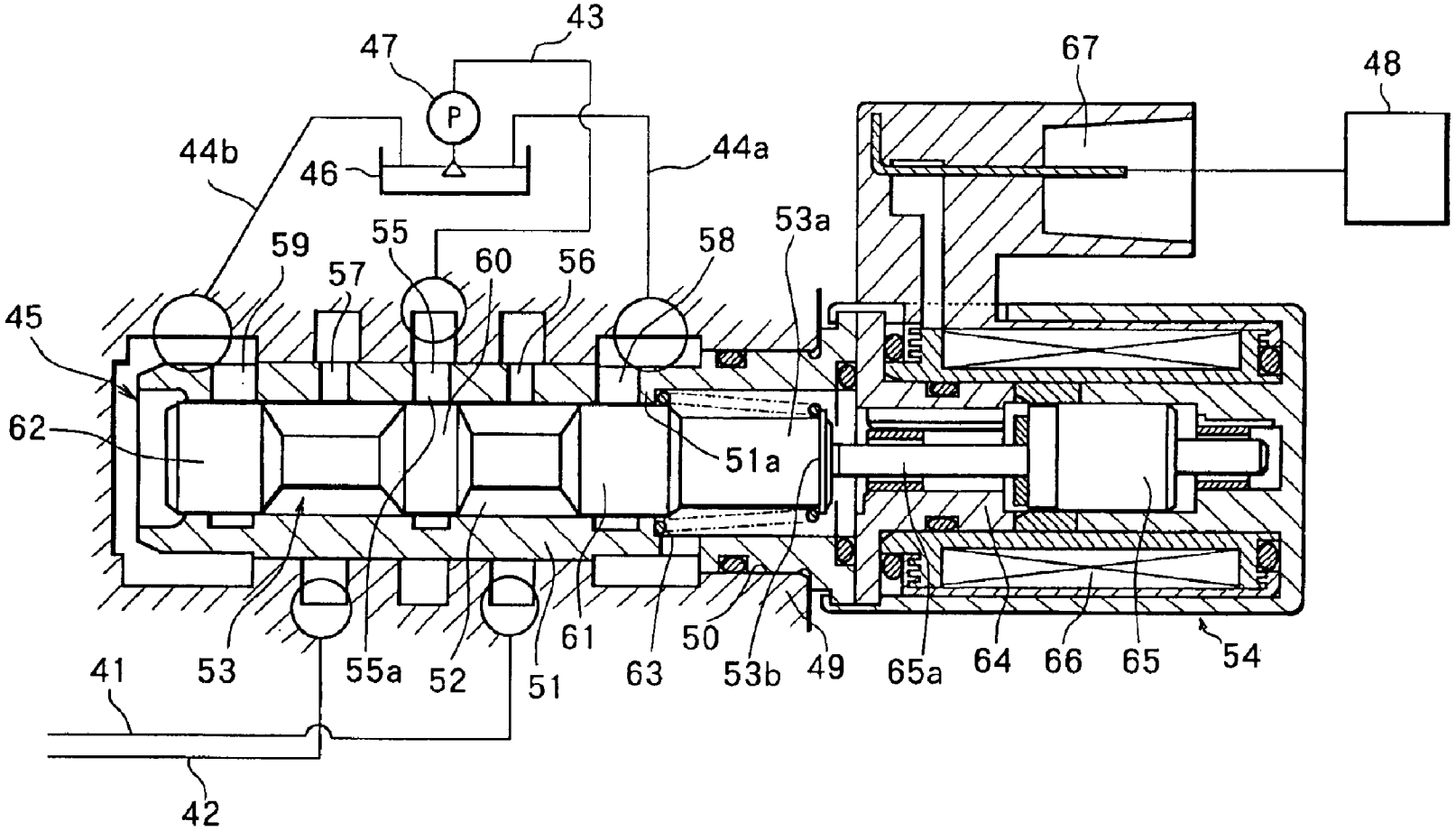
FIG. 4 is a cross-sectional view showing an electromagnetic switching valve in the variable valve timing mechanism.

More specifically, as shown in FIG. 4, electromagnetic switching valve 45 comprises a cylindrical valve body 51 insertingly secured inside a retaining bore 50 of a cylinder block 49, a spool valve 53 slidably provided inside a valve bore 52 in valve body 51 for switching the flow passages, and a proportional solenoid type electromagnetic actuator 54 for actuating spool valve 53.

With valve body 51, a supply port 55 is formed in a substantially central position of the peripheral wall, for communicating a downstream side end of supply passage 43 with valve bore 52, and a first port 56 and a second port 57 are respectively formed in opposite sides of supply port 55, for communicating the other end portions of first and second oil pressure passages 41 and 42 with valve bore 52.

Moreover, a third and fourth ports 58 and 59 are formed in the opposite end portions of the peripheral wall, for communicating two drain passages 44*a* and 44*b* with valve bore 52.

Spool valve 53 has a substantially columnar shape first valve portion 60 on a central portion of a small diameter axial portion, for opening and closing supply port 55, and has substantially columnar shape second and third valve portions 61 and 62 on opposite end portions, for opening and closing third and fourth ports 58 and 59.

Furthermore, spool valve 53 is urged to the right in the figure, that is, in a direction such that supply port 55 and second oil pressure passage 42 are communicated by first valve portion 60, by means of a conical shape valve spring 63 resiliently provided between an umbrella-shaped portion 53*b* on a rim of a front end spindle 53*a*, and a spring seat 51*a* on a front end inner peripheral wall of valve bore 52.

Electromagnetic actuator 54 is provided with a core 64, a moving plunger 65, a coil 66, and a connector 67. A drive rod 65*a* is secured to a tip end of moving plunger 65 for pressing against umbrella-shaped portion 53*b* of spool valve 53.

Controller 48 controls the energizing quantity for electromagnetic actuator 54 based on a duty control signal superimposed with a dither signal.

For example, when a control signal of duty ratio 0% (Off signal) is output from controller 48 to electromagnetic actuator 54, spool valve 53 moves towards the maximum right direction in the figure, under the spring force of valve spring 63.

As a result, first valve portion 60 opens an opening end 55*a* of supply port 55 to communicate with second port 57, and at the same time second valve portion 61 opens an opening end of third port 58, and third valve portion 62 closes fourth port 59.

Therefore, the hydraulic fluid pumped from oil pump 47 is supplied to delay angle side hydraulic chambers 33 via supply port 55, valve bore 52, second port 57, and second oil pressure passage 42, and the hydraulic fluid inside advance angle side hydraulic chambers 32 is discharged to inside oil pan 46 from first drain passage 44*a* via first oil pressure passage 41, first port 56, valve bore 52, and third port 58.

Consequently, the pressure inside delay angle side hydraulic chambers 33 becomes high while the pressure inside advance angle side hydraulic chambers 32 becomes low, and rotation member 3 is rotated to the full to the delay angle side by means of vanes 28*a* to 28*d*. The result of this is that the opening timing for the intake valve is delayed, and the overlap with the exhaust valve is thus reduced.

On the other hand, when a control signal of a duty ratio 100% (On signal) is output from controller 48 to electromagnetic actuator 54, spool valve 53 slides fully to the left in the figure, against the spring force of valve spring 63. As a result, second valve portion 61 closes third port 58 and at the same time third valve portion 62 opens fourth port 59, and first valve portion 60 allows communication between supply port 55 and first port 56.

Therefore, the hydraulic fluid is supplied to inside advance angle side hydraulic chambers 32 via supply port 55, first port 56, and first oil pressure passage 41, and the hydraulic fluid inside delay angle side hydraulic chambers 33 is discharged to oil pan 46 via second oil pressure passage 42, second port 57, fourth port 59, and second drain passage 44*b*, so that delay angle side hydraulic chambers 33 become a low pressure.

Therefore, rotation member 3 is rotated to the full to the advance angle side by means of vanes 28*a* to 28*d*. Due to this, the opening timing for the intake valve is advanced (advance angle) and the overlap with the exhaust valve is thus increased.

When a control signal having a duty ratio of 50% is output from controller 48 to electromagnetic actuator 54, spool valve 53 takes a position where first valve portion 60 closes supply port 55, second valve portion 61 closes third port 58, and third valve portion 62 closes fourth port 59.

Moreover, controller 48 sets by proportional, integral and derivative control action, a feedback correction amount PIDDTY for making a relative rotation position (rotation phase) of cam sprocket 1 and camshaft 103, in other words, a rotation phase of camshaft 103 relative to crankshaft 107, coincide with a target value corresponding to the operating conditions.

Controller 48 then makes the result of adding a base duty ratio BASEDTY (for example, 50%) to the feedback correction amount PIDDTY a final duty ratio VTCDTY, and outputs the control signal for the duty ratio VTCDTY to electromagnetic actuator 54.

Namely, in the case where it is necessary to change the relative rotation position (rotation phase) in the delay angle direction, the duty ratio is reduced by means of the feedback correction amount PIDDTY, so that the hydraulic fluid pumped from oil pump 47 is supplied to delay angle side hydraulic chambers 33, and at the same time the hydraulic fluid inside advance angle side hydraulic chambers 32 is discharged to inside oil pan 46.

Conversely, in the case where it is necessary to change the relative rotation position (rotation phase) in the advance angle direction, the duty ratio is increased by means of the feedback correction amount PIDDTY, so that the hydraulic fluid is supplied to inside advance angle side hydraulic chambers 32, and at the same time the hydraulic fluid inside delay angle side hydraulic chambers 33 is discharged to oil pan 46.

Furthermore, in the case where the relative rotation position (rotation phase) is maintained in the current condition, the absolute value of the feedback correction amount PIDDTY decreases to thereby control so as to return to a duty ratio close to the base duty ratio.

In order to detect the rotation phase of crankshaft 107 and camshaft 103, there are provided a cam sensor 110 taking out cylinder discrimination signals Phase from camshaft 103, and a crank sensor 111 taking out position signals POS from crankshaft 107.

Figure 5:
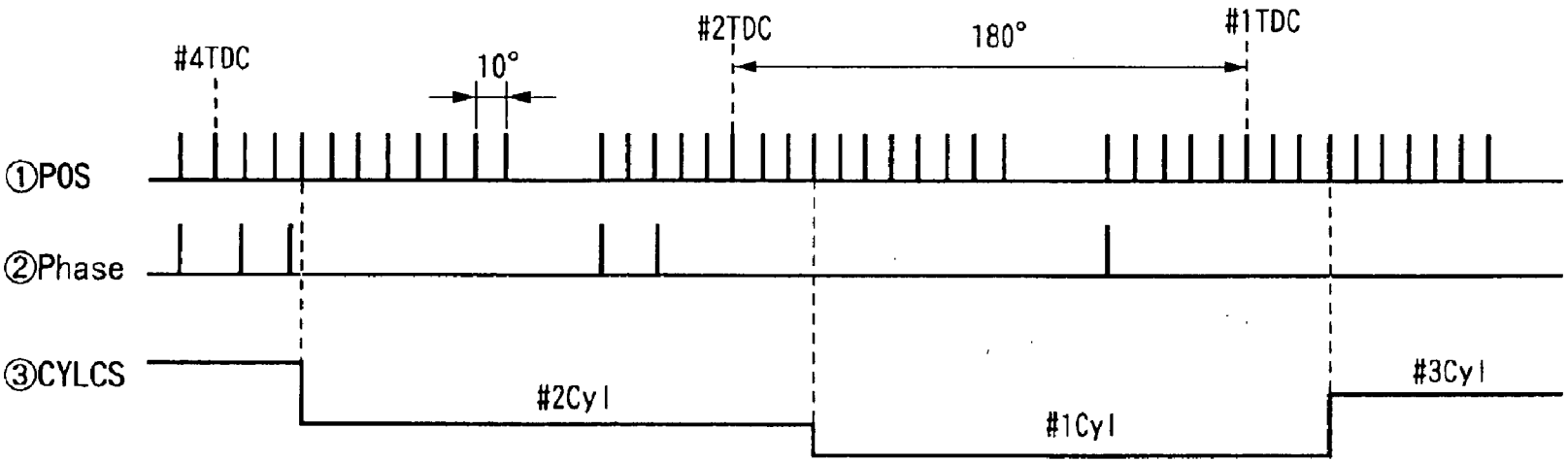
FIG. 5 is a time chart showing output characteristics of position signals from a crank sensor and cylinder discrimination signals from a cam sensor.

As shown in FIG. 5, crank sensor 111 is a sensor that outputs position signals POS every 10 degrees of crank angle in synchronism with the compression top dead center TDC of each cylinder, and omission of position signal POS occurs continuously at positions corresponding to 60 degrees and 70 degrees before the top dead center of each cylinder.

It is assumed that engine 101 in the present embodiment is, as mentioned before, an in-line four-cylinder engine, wherein a stroke phase difference between cylinders is 180 degrees in crank angle, and the order of ignition is #1 cylinder, #3 cylinder, #4 cylinder, and #2 cylinder.

On the other hand, cam sensor 110 outputs cylinder discrimination signals Phase so as to indicate a cylinder by the number of pulses at every stroke phase difference.

When camshaft 103 is at a maximum delay angle position (the state shown in FIG. 5) variable valve timing mechanism 108, a leading signal in a group of cylinder discrimination signals Phase is set to be generated immediately after the signal omission position of the position signals POS.

Actually, three pulse signals corresponding to #3 cylinder are output, with the signal omission position of the position signals POS before the compression Top Dead Center (TDC) of #3 cylinder as a reference.

Similarly, four pulse signals corresponding to #4 cylinder are output, with the signal omission position of the position signals POS before the compression top dead center of #4 cylinder as a reference.

Two pulse signals corresponding to #2 cylinder are output, with the signal omission position of the position signals POS before the compression top dead center of #2 cylinder as a reference.

Further, one pulse signal corresponding to #1 cylinder is output, with the signal omission position of the position signals POS before the compression top dead center of #1 cylinder as a reference.

Here, cam sensor 110, controller 48 and electromagnetic switching valve 45 are formed integrally to be mounted to engine 101 as a single unit called a VTC control unit 119.

Figure 6:
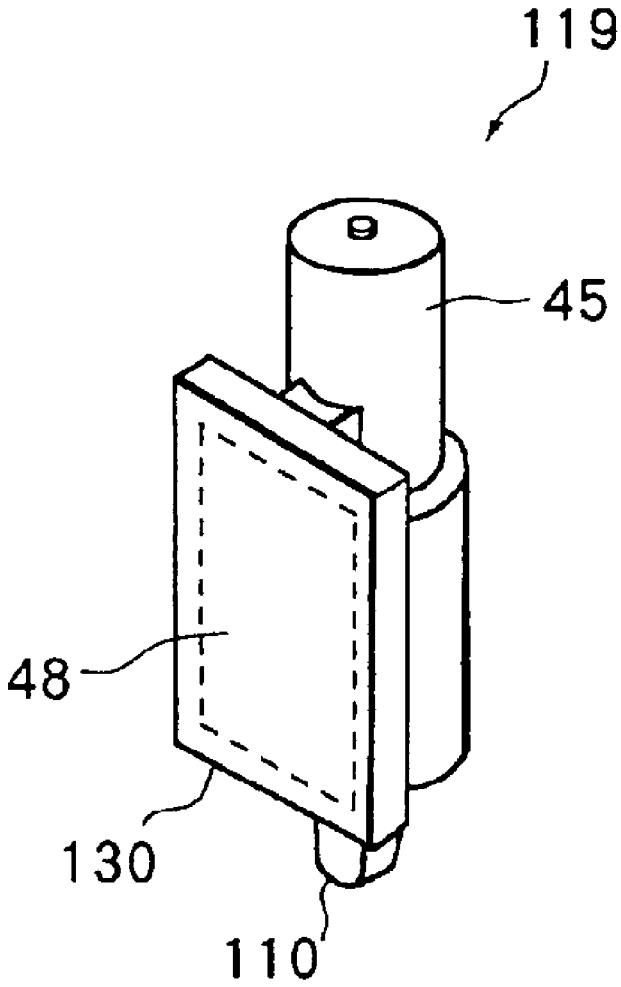
FIG. 6 is a perspective view of a control unit.

Actually, as shown in FIG. 6, electromagnetic switching valve 45 and cam sensor 110 are integrally mounted on a case 130 accommodating a control substrate constituting controller 48, so that the control duty signals from controller 48 are sent to electromagnetic switching valve 45 and the cylinder discrimination signals Phase from cam sensor 110 are input to controller 48.

Case 130 (VTC control unit 119) is mounted to the cylinder head or the fuel piping and the like near variable valve timing mechanism 108 so that cam sensor 110 detects a portion to be detected on camshaft 103 side.

The position signals POS from crank sensor 111 are sent to controller 48 via a harness.

Controller 48 computes the rotation phase of camshaft 103 relative to crankshaft 107 based on the cylinder discrimination signals Phase from integrally formed cam sensor 110 and the position signals POS from crank sensor 111.

Then, controller 48 feedback controls the duty control signals output to electromagnetic actuator 54, and also discriminates a cylinder corresponding to the reference piston position (cylinder discrimination process), to transmit the result as digital signals to an engine controller 120 provided individually for each cylinder.

Based on the result of the cylinder discrimination process sent from controller 48 of variable valve timing mechanism 108, engine controller 120 controls the fuel injection timing of each cylinder, and controls the ignition timing of each cylinder.

Cam sensor 110 is mounted integrally to controller 48, thereby preventing ignition noise from mixing into the output of cam sensor 110, and preventing deterioration of the accuracy of the rotation phase detection and cylinder discrimination process due to ignition noise.

Since the cylinder discrimination is performed by controller 48 of variable valve timing mechanism 108, an operation load of engine controller 120 is reduced.

Next, the rotation phase detection and cylinder discrimination process performed by controller 48 is described in detail with reference to flowcharts of FIGS. 7 and 8.

Figure 7:
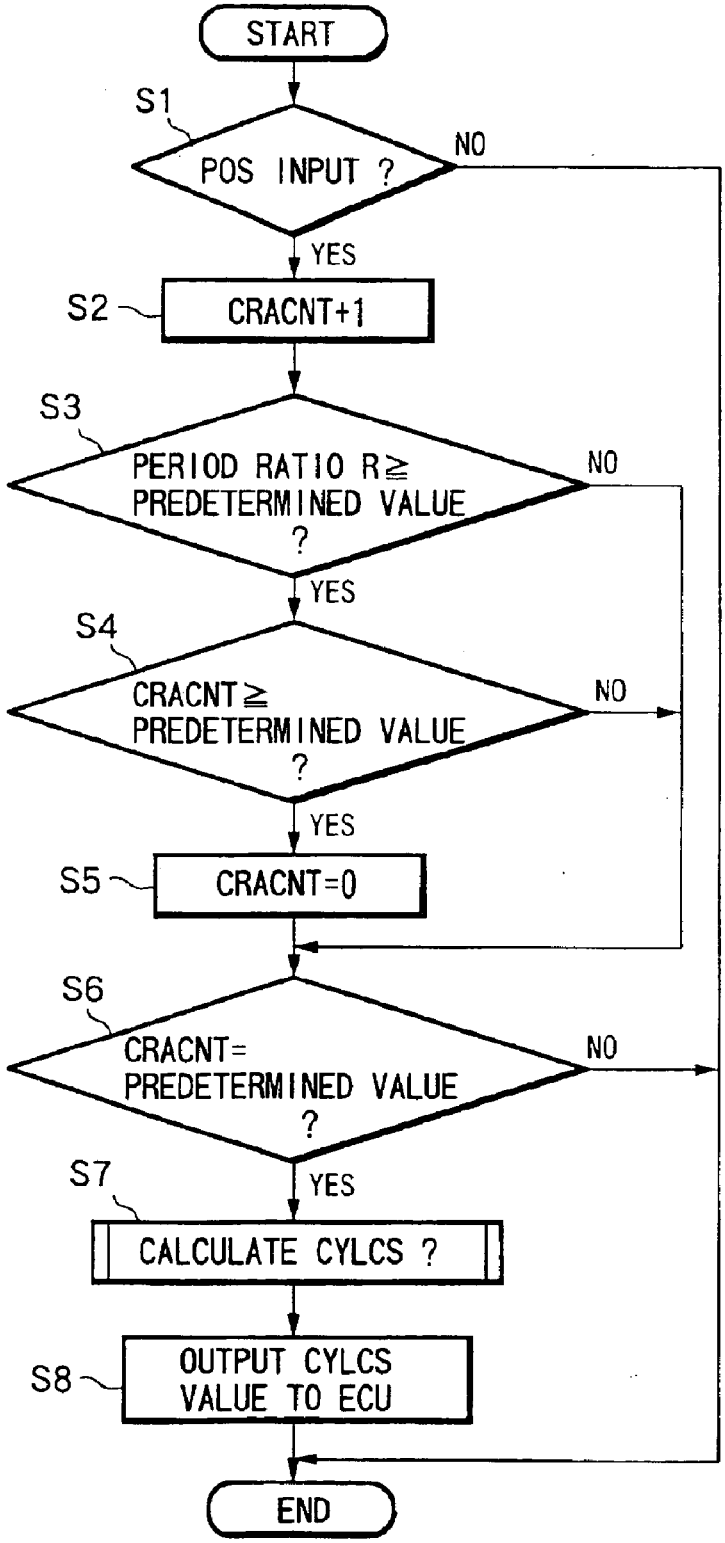
FIG. 7 is a flowchart showing a cylinder discrimination process for discriminating a cylinder corresponding to a reference piston position.

The flowchart of FIG. 7 shows a cylinder discrimination process routine. In step S1, it is judged whether or not the position signal POS has been input, and if the position signal POS has been input, control proceeds to step S2.

In step S2, 1 is added to a value of counter CRACNT that counts the generating frequency of position signals POS.

In step S3, it is judged whether or not a ratio R of the newest value Tnew and the previous value Told of the generation period T of the position signal POS (R=Tnew/Told) is greater than a predetermined value.

If the newest value Tnew is a result obtained by measuring a period of signal omission portion of the position signals POS, Tnew represents a 30-degree period in crank angle, and Told represents a 10-degree period in crank angle, leading R>predetermined value.

Accordingly, if R>predetermined value, it is judged that the present position signal POS is a signal output immediately after the signal omission portion.

When it is judged that R>predetermined value in step S3, control proceeds to step S4, where judgment is made on whether or not the value of counter CRACNT is equal to or greater than a predetermined value.

Then, if the value of counter CRACNT is equal to or greater than a predetermined value (1), control proceeds to step S5 where the value of the counter CRACNT is reset to 0.

In step S6, by judging whether or not the value of counter CRACNT is equal to a predetermined value (2), it is judged whether or not the position is a reference crank angle position (for example, BTDC 30 degrees), which is after a predetermined angle from the signal omission position.

When the value of counter CRACNT is equal to the predetermined value (2), control proceeds to step S7, where the cylinder discrimination process (update of cylinder discrimination value CYLCS) is executed based on a value of counter CAMCNT at that time.

The counter CAMCNT is a counter that counts the cylinder discrimination signals Phase, and since the reference crank angle position where the value of counter CRACNT is equal to the predetermined value (2) is located between the previous generation of cylinder discrimination signal group and the next generation thereof, and since the value of counter CAMCNT is reset to 0 after the previous cylinder discrimination, the value of the counter CAMCNT judged at step S7 denotes the number of a cylinder discrimination signal Phase group that had been output just before.

For example, if the value of counter CAMCNT is 2, it is the timing where the immediately previous TDC is the compression TDC of #2 cylinder and the next TDC is the compression TDC of #1 cylinder, so the result of cylinder discrimination process is updated to #1 cylinder (cylinder discrimination value CYLCS is updated to 1), and after the update process, the value of counter CAMCNT is reset to 0.

In step S8, the result of cylinder discrimination process (cylinder discrimination value CYLCS) is output as digital signals to engine controller 120.

The transmission of the result of cylinder discrimination process as digital signals can be performed using a network that realizes intercommunication between controllers (for example, a LAN or a CAN: Controller Area Network), and the signal mode can be either parallel or serial.

Figure 8:
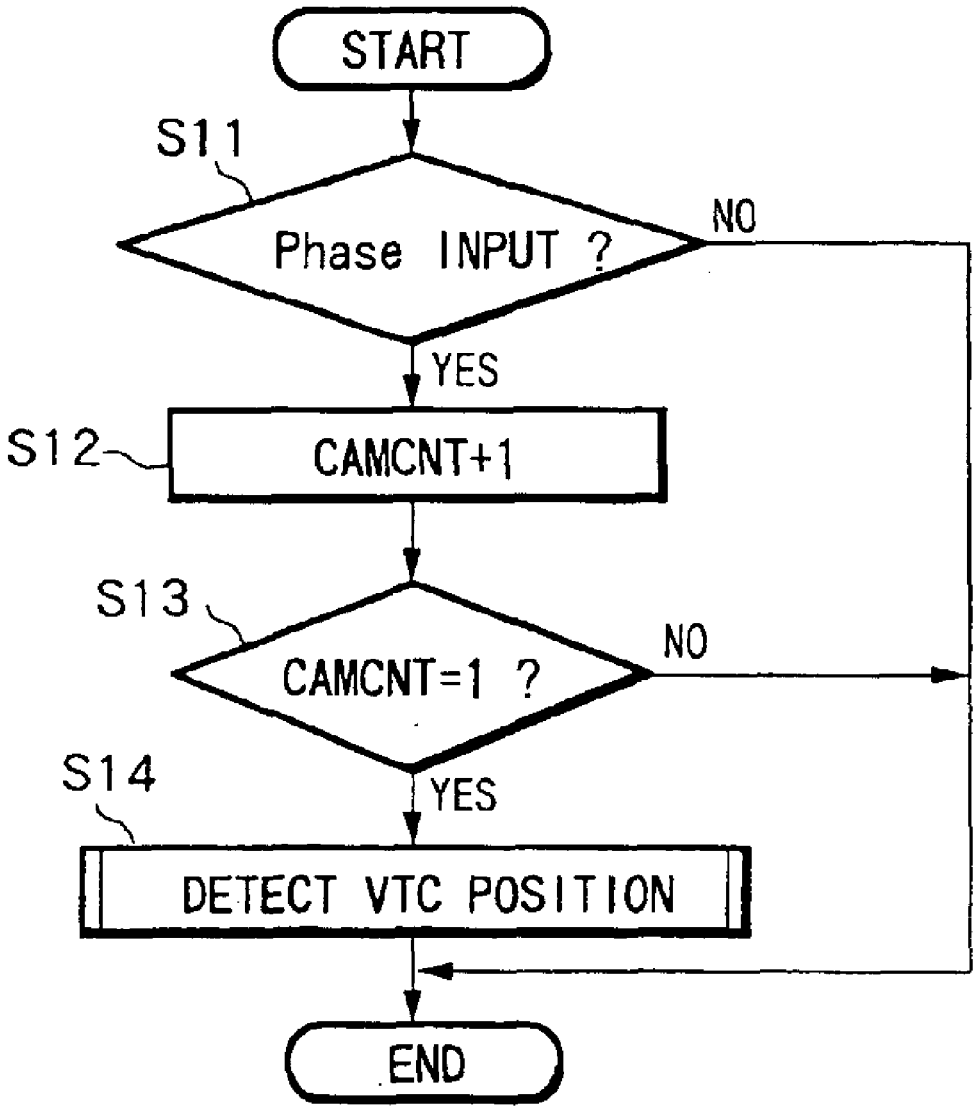
FIG. 8 is a flowchart showing a computation process for computing a rotation phase of a camshaft relative to a crankshaft.

The flowchart of FIG. 8 shows a routine for detecting the rotation phase. In step S11, it is judged whether or not the cylinder discrimination signal Phase has been input.

When the cylinder discrimination signal Phase has been input, control proceeds to step S12, where 1 is added to the value of counter CAMCNT.

In the next step S13, by judging whether or not the value of counter CAMCNT is 1, it is judged whether or not the present cylinder discrimination signal Phase is a leading signal among a group of signals of the number indicating the cylinder.

If the value of counter CAMCNT is 1 (CAMCNT=1) and the present cylinder discrimination signal Phase is the leading signal, control proceeds to step S14 where the rotation phase is computed.

The rotation phase is computed for example by computing an angle from the reference crank angle position to the reference cam angle position based on the value of counter CRACNT for the position signal POS and the angle obtained by converting the period of time from the immediately previous position signal POS to the present cylinder discrimination signal Phase with the engine rotation speed at that time.

The above-mentioned angle is the angle indicating the rotation phase of camshaft 103 relative to crankshaft 107, and the value thereof decreases according to the advance angle control of the valve timing performed by variable valve timing mechanism 108.

Controller 48 feedback controls the control signal of electromagnetic actuator 54 according to the deviation between the computed angle indicating the rotation phase and the target value.

The entire contents of Japanese Patent Application No. 2001-184875, filed Jun. 19, 2001 are incorporated herein by reference.

While only selected embodiments have been chosen to illustrate the present invention, it will be apparent to those skilled in the art from this disclosure that various changes and modifications can be made herein without departing from the scope of the invention as defined in the appended claims.

Furthermore, the foregoing description of the embodiments according to the present invention is provided for illustration only, and not for the purpose of limiting the invention as defined by the appended claims and their equivalents.

What is claimed is:

1. A control unit for a variable valve timing mechanism for changing a rotation phase of a camshaft relative to a crankshaft in an engine, comprising:

a cam sensor, that takes out from said camshaft, signals for discriminating a cylinder corresponding to a reference piston position; and a controller that outputs control signals to an actuator of said variable valve timing mechanism, wherein said cam sensor is integrally mounted to a case that accommodates said controller, and said case is mounted to the engine.

2. A control unit for a variable valve timing mechanism according to claim 1, wherein said variable valve timing mechanism is a mechanism for changing the rotation phase of the camshaft relative to the crankshaft using hydraulic pressure, said variable valve timing mechanism further comprises a valve body that controls the supply of hydraulic oil, and said valve body and said actuator together with said cam sensor are integrally mounted to said case.

3. A control unit for a variable valve timing mechanism according to claim 1, wherein said controller is input with detection signals from a crank sensor that takes out from said crankshaft signals indicating a reference crank angle position, computes said rotation phase based on detection signals from said cam sensor and the detection signals from said crank sensor, and also computes control signals to be output to said actuator based on said rotation phase.

4. A control unit for a variable valve timing mechanism according to claim 3, wherein said cam sensor outputs signals indicating a cylinder by the number of pulses at every angle corresponding to a stroke phase difference between cylinders;

said crank sensor generates position signals at every unit crank angle, said position signals being omitted at every angle corresponding to the stroke phase difference between cylinders; and said controller detects an omission position of position signals from the crank sensor as the reference crank angle position, measures an angle from said reference crank angle position to a leading signal of detection signals output from said cam sensor, and computes said rotation phase based on said measured angle.

5. A control unit for a variable valve timing mechanism according to claim 1, wherein said controller discriminates a cylinder corresponding to the reference piston position based on detection signals from said cam sensor, and outputs signals indicating the discrimination result to outside.

6. A control unit for a variable valve timing mechanism according to claim 5, wherein said controller outputs signals indicating the discrimination result of the cylinder corresponding to the reference piston position to engine controllers each controlling fuel injection timing and ignition timing of each cylinder in the engine.

7. A control unit for a variable valve timing mechanism according to claim 6, wherein said controller transmits the discrimination result of the cylinder corresponding to the reference piston position to said engine controllers as digital signals.

* * * * *